US011521538B2

(12) United States Patent
Jo et al.

(10) Patent No.: US 11,521,538 B2
(45) Date of Patent: Dec. 6, 2022

(54) DISPLAY DEVICE AND METHOD OF DRIVING THE SAME

(71) Applicant: Samsung Display Co., Ltd., Yongin-Si (KR)

(72) Inventors: A Ra Jo, Yongin-si (KR); Kang Hee Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/382,211

(22) Filed: Jul. 21, 2021

(65) Prior Publication Data

US 2022/0157220 A1 May 19, 2022

(30) Foreign Application Priority Data

Nov. 16, 2020 (KR) ..... 10-2020-0152944

(51) Int. Cl.
*G09G 3/20* (2006.01)

(52) U.S. Cl.
CPC ..... *G09G 3/2044* (2013.01); *G09G 2310/027* (2013.01); *G09G 2310/08* (2013.01)

(58) Field of Classification Search
CPC ..... G09G 3/2044; G09G 3/2051
See application file for complete search history.

(56) References Cited

U.S. PATENT DOCUMENTS

| | | | | |
|---|---|---|---|---|
| 9,799,260 | B2 | 10/2017 | Song et al. | |
| 9,870,732 | B2 | 1/2018 | Park et al. | |
| 2008/0211749 | A1* | 9/2008 | Weitbruch | G09G 3/3233 345/77 |
| 2009/0122088 | A1 | 5/2009 | Kim | |
| 2016/0225305 | A1* | 8/2016 | Song | G09G 3/2055 |
| 2019/0182509 | A1* | 6/2019 | Kim | H04N 19/80 |

FOREIGN PATENT DOCUMENTS

| | | | |
|---|---|---|---|
| KR | 10-2005-0082118 | A | 8/2005 |
| KR | 10-0610494 | B1 | 8/2006 |
| KR | 10-0898299 | B1 | 5/2009 |
| KR | 10-2016-0072344 | A | 6/2016 |
| KR | 10-2016-0094474 | A | 8/2016 |

* cited by examiner

*Primary Examiner* — Sanjiv D. Patel
(74) *Attorney, Agent, or Firm* — Innovation Counsel LLP

(57) ABSTRACT

A display device includes a display area including a plurality of pixels; a low-grayscale dithering controller selecting a dither grayscale according to an input grayscale of input image data that is in a low grayscale range below a threshold grayscale, and generating dithered input image data by performing a dithering operation on the input image data of the low grayscale range based on the dither grayscale; and a display driver driving the plurality of pixels based on the dithered input image data.

15 Claims, 7 Drawing Sheets

| I_GRAY | RG |
|---|---|
| 1 | A |
| 2 | A |
| 3 | A |
| 4 | A |
| 5 | B |
| 6 | A |
| 7 | A |
| 8 | C |
| 9 | A |
| 10 | A |
| ⋮ | ⋮ |

FIG. 5A

LGDA

| | | | |
|---|---|---|---|
| DG1 | DG1 | DG1 | 0 |
| 0 | DG1 | 0 | DG1 |
| DG1 | 0 | DG1 | 0 |
| 0 | DG1 | 0 | DG1 |

I_GRAY1

FIG. 5B

LGDA

| | | | |
|---|---|---|---|
| DG2 | 0 | DG2 | 0 |
| 0 | DG2 | 0 | 0 |
| 0 | 0 | DG2 | 0 |
| DG2 | 0 | 0 | DG2 |

I_GRAY2

LGDA

| | | | |
|---|---|---|---|
| 0 | DG1 | 0 | DG1 |
| 0 | 0 | DG1 | 0 |
| DG1 | 0 | 0 | DG1 |
| 0 | DG1 | 0 | 0 |

I_GRAY3

LGDA

| | | | |
|---|---|---|---|
| 0 | DG3 | 0 | 0 |
| 0 | 0 | DG3 | 0 |
| DG3 | 0 | 0 | 0 |
| 0 | 0 | 0 | DG3 |

I_GRAY4

DISPLAY DEVICE AND METHOD OF DRIVING THE SAME

CROSS-REFERENCE TO RELATED APPLICATION

The application claims priority to and the benefit of Korean Patent Application No. 10-2020-0152944, filed Nov. 16, 2020, the disclosure of which is incorporated by reference in its entirety.

BACKGROUND

Field

The present disclosure relates to a display device, and more particularly, to a display device capable of dithering a displayed image.

Discussion

A display device displays an image using pixels according to input image data received from an external device. The display device may process the input image data in various ways to improve display quality. For example, the display device may perform a dithering operation to express additional grayscale and luminance using a limited grayscale.

The display device may improve its display quality by performing the dithering operation on the displayed image.

SUMMARY

The present disclosure provides a display device capable of dithering a low grayscale image by selecting a dither grayscale according to an input grayscale of input image data that is in a low grayscale range.

In addition, the present disclosure provides a method of driving the display device by performing a dithering operation.

However, the present disclosure is not limited to the above-described display device and method of driving the display device, and the display device and the method of driving the display device disclosed herein may be variously extended without departing from the spirit and scope of the present disclosure.

According to an embodiment of the present disclosure, a display device may include a display area including a plurality of pixels; a low-grayscale dithering controller selecting a dither grayscale according to an input grayscale of input image data that is in a low grayscale range below a threshold grayscale, and generating dithered input image data by performing a dithering operation on the input image data in the low grayscale range based on the dither grayscale; and a display driver driving the plurality of pixels based on the dithered input image data.

According to an embodiment, the low-grayscale dithering controller may include a memory storing a lookup table that includes a plurality of reference grayscales corresponding to each of grayscales in the low grayscale range. The low-grayscale dithering controller may select one of the plurality of reference grayscales as the dither grayscale in response to the input grayscale.

According to an embodiment, the plurality of reference grayscales may be greater than the threshold grayscale.

According to an embodiment, the low-grayscale dithering controller may perform the dithering operation by expressing the input grayscale based on the dither grayscale and a black grayscale.

According to an embodiment, for the dither grayscale being same, a ratio to which the dither grayscale is applied in a low grayscale dithering area in the display area in which the dithering operation is performed may increase as the input grayscale increases.

According to an embodiment, the low-grayscale dithering controller may select a first dither grayscale in response to a first input grayscale, and select a second dither grayscale in response to a second input grayscale that is smaller than the first input grayscale. The second dither grayscale may be greater than the first dither grayscale.

According to an embodiment, the low-grayscale dithering controller may select the first dither grayscale in response to a third input grayscale that is smaller than the second input grayscale.

According to an embodiment, in the low grayscale dithering area of the display area, a second ratio to which the second dither grayscale is applied may be different from at least one of a first ratio to which the first dither grayscale is applied in response to the first input grayscale and a third ratio to which the first dither grayscale is applied in response to the third input grayscale.

According to an embodiment, in the low grayscale dithering area, the second ratio to which the second dither grayscale is applied may be less than or equal to the third ratio to which the first dither grayscale is applied in response to the third input grayscale.

According to an embodiment, the display driver may include a data driver supplying a data voltage of the dither grayscale and a black data voltage of the black grayscale to the plurality of pixels.

According to an embodiment, a second voltage deviation between a second data voltage of the second dither grayscale and the black data voltage may be greater than a first voltage deviation between a first data voltage of the first dither grayscale and the black data voltage.

According to an embodiment, the low grayscale range may include grayscales that are equal to or greater than the black grayscale and lower than the threshold grayscale.

According to an embodiment, the black grayscale may be a lowest grayscale, the threshold grayscale may be a tenth grayscale of an eight-bit grayscale, and the reference grayscales may be eleventh to fifteenth grayscales of the eight-bit grayscale.

According to another embodiment of the present disclosure, a method of driving a display device may include setting a low grayscale dithering area in a display area based on an input grayscale of input image data in a low grayscale range below a threshold grayscale; selecting one of a plurality of reference grayscales as a dither grayscale in response to the input grayscale, wherein the plurality of reference grayscales may correspond to each of grayscales in the low grayscale range; and performing image dithering in the low grayscale dithering area based on the dither grayscale and a black grayscale.

According to an embodiment, for the dither grayscale being same, the method may further include increasing a ratio to which the dither grayscale is applied in the low grayscale dithering area as the input grayscale increases.

According to an embodiment, the method may further include selecting a first dither grayscale in response to a first input grayscale, and selecting a second dither grayscale in response to a second input grayscale that is smaller than the first input grayscale. The second dither grayscale may be greater than the first dither grayscale.

According to an embodiment, the method may further include selecting the first dither grayscale in response to a third input grayscale that is smaller than the second input grayscale.

According to an embodiment, in the low grayscale dithering area, a second ratio to which the second dither grayscale is applied may be equal to or less than a first ratio to which the first dither grayscale is applied in response to the third input grayscale.

According to an embodiment, a second voltage deviation between a second data voltage of the second dither grayscale and a black data voltage of the black grayscale may be greater than a first voltage deviation between a first data voltage of the first dither grayscale and the black data voltage.

According to an embodiment, the low grayscale range may include grayscales equal to or greater than the black grayscale and lower than the threshold grayscale.

BRIEF DESCRIPTION OF THE DRAWINGS

The accompanying drawings are included to provide a further understanding of the inventive concepts, and are incorporated in and constitute a part of the present disclosure. The drawings illustrate some embodiments of the inventive concepts, and, together with the detailed description, serve to explain principles of the inventive concepts.

FIGS. 5A, 5B, and 5C are diagrams illustrating examples of operations of the low-grayscale dithering controller of FIG. 2.

FIG. 6 is a diagram illustrating an example of a relationship between dither grayscales and data voltages.

DETAILED DESCRIPTION OF THE ILLUSTRATED EMBODIMENTS

Figure 1:
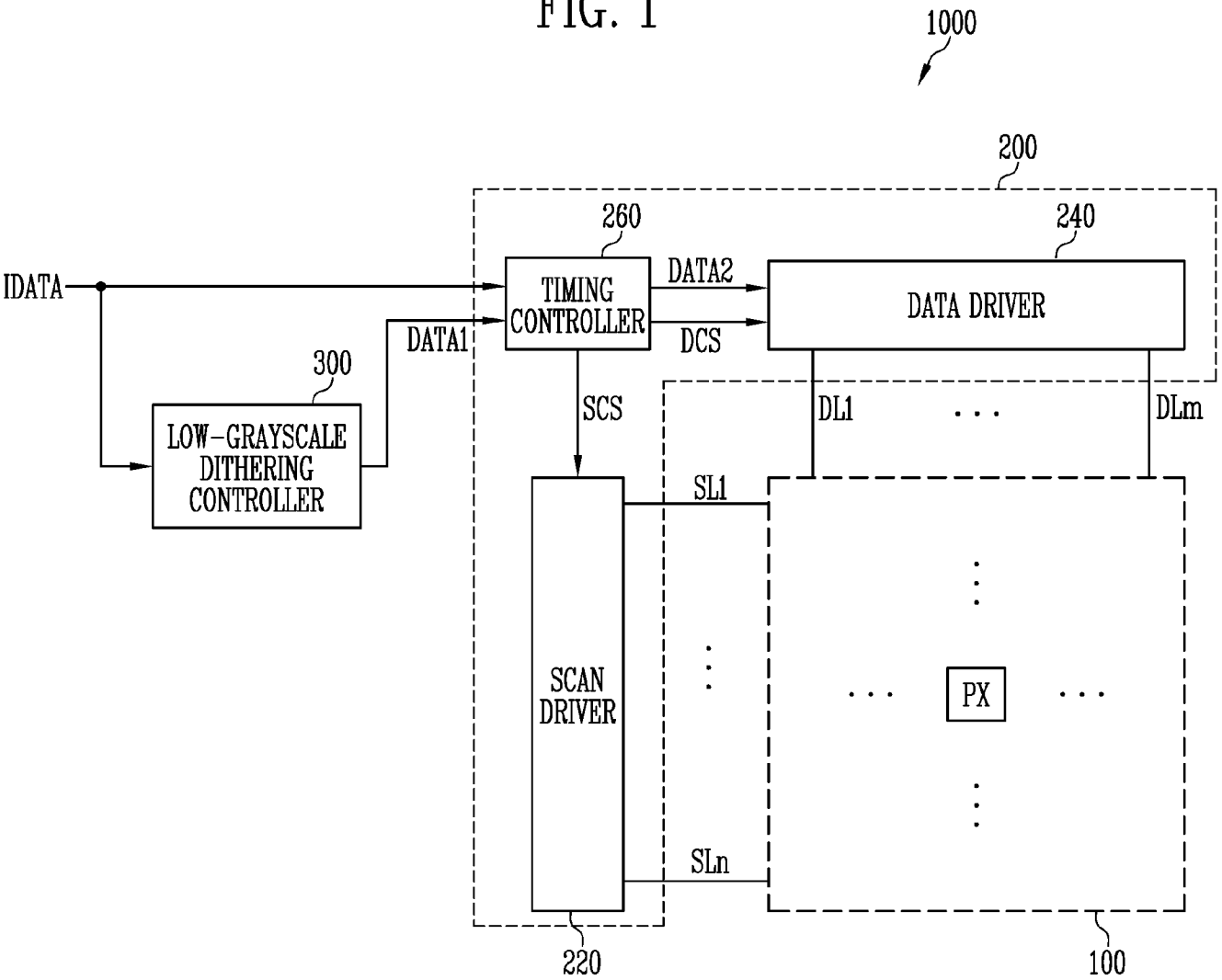
FIG. 1 is a block diagram illustrating a display device according to an embodiment.

Hereinafter, some embodiments of the present disclosure will be described in detail with reference to the accompanying drawings. The same reference numerals are used for the same components in the drawings, and duplicate descriptions for the same components are omitted.

FIG. 1 is a block diagram illustrating a display device according to an embodiment.

Referring to FIG. 1, a display device 1000 may include a display area 100, a display driver 200, and a low-grayscale dithering controller 300.

The display device 1000 may be a flat panel display device, a flexible display device, a curved display device, a foldable display device, a bendable display device, or a stretchable display device. In addition, the display device 1000 may be applied to a transparent display device, a head-mounted display device, a wearable display device, or the like. In addition, the display device 1000 may be applied to various electronic devices such as a smart phone, a tablet computer, a smart pad, a television (TV), a monitor, or the like.

The display device 1000 may be implemented as a self-light emitting display device including a plurality of self-light emitting elements. For example, the display device 1000 may be an organic light emitting display device including organic light emitting elements, a display device including inorganic light emitting elements, or a display device including light emitting elements including a combination of inorganic and organic materials. However, this is merely an example, and the display device 1000 may be implemented as a liquid crystal display device, a plasma display device, a quantum dot display device, or the like.

The display area 100 may include scan lines SL1 to SLn, data lines DL1 to DLm, and pixels PX, where n and m may be integers greater than 1. The pixels PX may be electrically connected to the data lines DL1 to DLm and the scan lines SL1 to SLn. According to an embodiment, at least one scan line may be connected to each of the pixels PX.

Each of the pixels PX may emit light with luminance according to a grayscale that corresponds to a data voltage supplied from the data lines DL1 to DLm.

The low-grayscale dithering controller 300 may select a dither grayscale according to a grayscale (an input grayscale) of input image data IDATA corresponding to a low grayscale range. There may be a plurality of dither scales stored in a look-up table, and the low-grayscale dithering controller 300 may select a dither grayscale among the plurality of dither scales by looking up the look-up table. The low grayscale range may include grayscale values below a predetermined threshold grayscale. For example, the low grayscale range may include low grayscales that a light emitting element may not express with a driving current provided from a driving transistor of a pixel PX. In a case where the grayscale of the input image data IDATA is expressed in 8 bits (i.e., 256 grayscales or 256 levels of luminance), the threshold grayscale may be 10 grayscale, and the low grayscale range may include 1 to 10 grayscales.

The low-grayscale dithering controller 300 may generate dithered input image data by performing a dithering operation on the low grayscale range of the input image data IDATA based on the dither grayscale. The low-grayscale dithering controller 300 may provide the dithered input image data to the display driver 200 as first data DATA1. For example, the first data DATA1 may be image data corresponding to a low grayscale dithering area of the display area 100. Accordingly, a grayscale that are not expressed by the driving current in the low grayscale dithering area may be output by the dithering operation. For example, 0 grayscale may be a black grayscale, and dithering may not be applied to the black scale.

The dithering operation may be performed by various dithering methods. For example, a spatial dithering and/or temporal dithering method may be used to perform the dithering operation on the low grayscale range.

In an embodiment, the temporal dithering method may widen expression of a grayscale range by varying the grayscale over time. For example, when the 0 grayscale (or black grayscale) and the dither grayscale are alternately displayed according to frames and/or positions, and a ratio of the dither grayscale is changed in a predetermined area, the temporal dithering method may express low grayscales between the 0 grayscale and the dither grayscale.

The display driver 200 may drive the pixels PX based on the input image data IDATA. In an embodiment, the display driver 200 may include a scan driver 220, a data driver 240, and a timing controller 260.

The timing controller 260 may receive the input image data IDATA (e.g., red/green/blue (RGB) data) from an external device (e.g., a graphic processor) and receive the first data DATA1 from the low-grayscale dithering controller 300. The timing controller 260 may generate a scan control signal SCS and a data control signal DCS based on a control signal received from the external device. In addition, the timing controller 260 may rearrange the input image data IDATA and the first data DATA1 into second data DATA2 corresponding to the pixel arrangement of the display area 100 and output the second data DATA2 to the data driver 200.

The scan driver 220 may receive the scan control signal SCS from the timing controller 260, and supply a scan signal to the scan lines SL1 to SLn accordingly. For example, the scan control signal SCS may include a start signal, a clock signal, or the like.

The scan driver 220 may be disposed on the display area 100 (or an area of a display panel) or may be implemented as an integrated chip (IC) and mounted on a flexible circuit board to be connected to the display area 100. In an embodiment, the scan driver 220 may be positioned on opposing sides (e.g., left and right sides) of the display area 100.

The data driver 240 may generate a data voltage based on the data control signal DCS and the second data DATA2 and provide the data voltage to the data lines DL1 to DLm. The data control signal DCS may control an operation of the data driver 240 and may include a data enable signal or the like.

The data driver 240 may be implemented as an IC (e.g., a driver IC) and may be mounted on a flexible circuit board to be connected to the display area 100.

Although FIG. 1 shows n scan lines, i.e., Si to Sn, but the present disclosure is not limited thereto. As an example, corresponding to a circuit structure of the pixels PX, the pixels PX that are connected to a scan line corresponding to the current horizontal line (or a current pixel row) may be additionally connected to a scan line corresponding to the previous horizontal line (or a previous pixel row) and/or a scan line corresponding to the next horizontal line (or a next pixel row). Dummy scan lines (not shown) may be additionally formed in the display area 100. Also, the display device 1000 may further include an emission driver (not shown) for controlling emission of light by the pixels PX.

In FIG. 1, the low-grayscale dithering controller 300, the timing controller 260, and the data driver 240 are shown as separate elements, but the present disclosure is not limited thereto. For example, at least some functions of the low-grayscale dithering controller 300 and/or the timing controller 260 may be implemented in the data driver 240, or the low-grayscale dithering controller 300 and/or the timing controller 260 may be included in the data driver 240.

Figure 2:
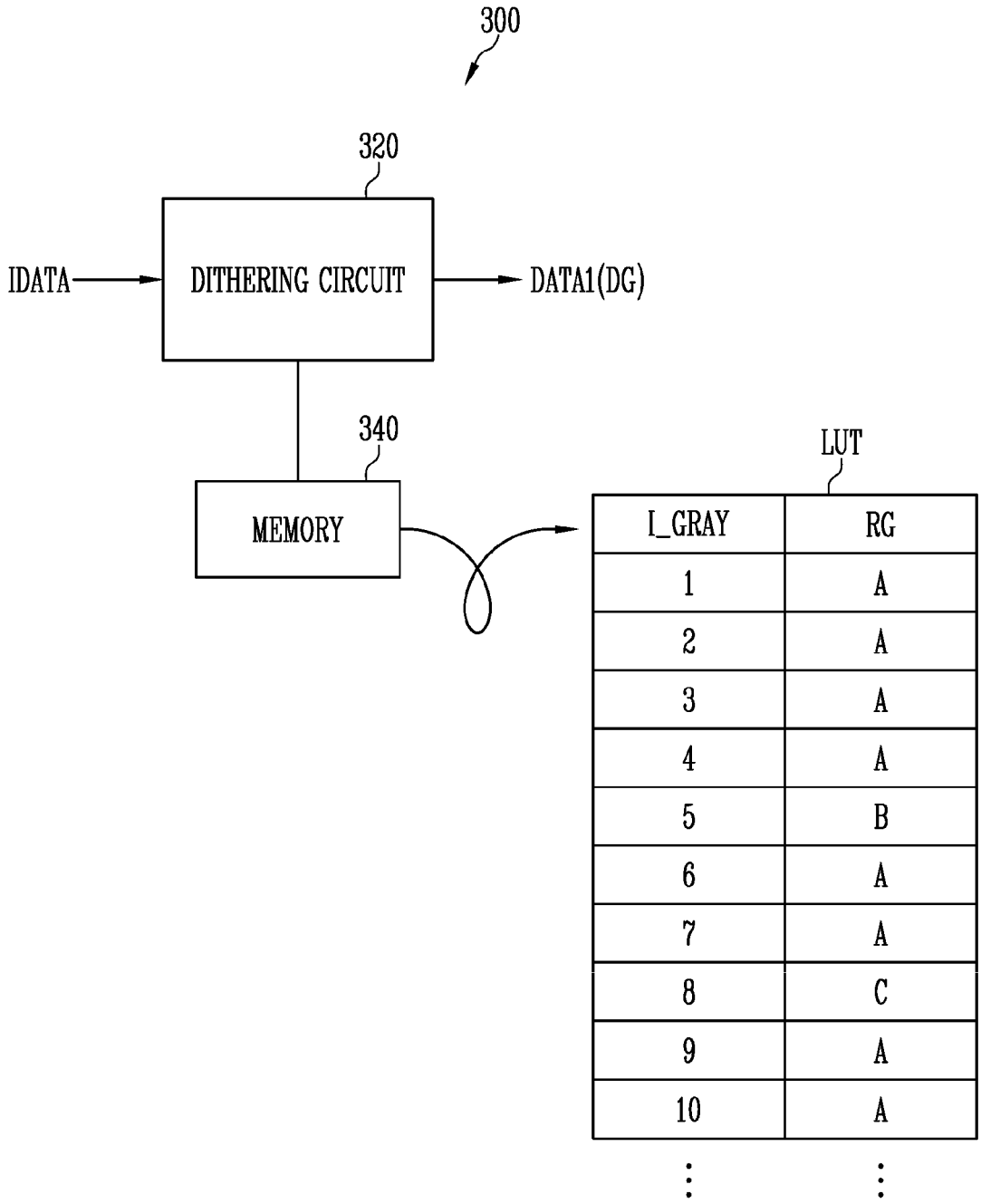
FIG. 2 is a diagram illustrating a low-grayscale dithering controller included in the display device of FIG. 1.
Figure 3:
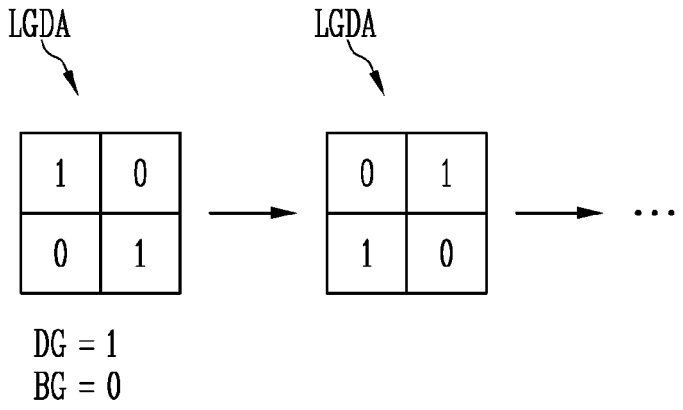
FIG. 3 is a diagram for explaining an operation of the low-grayscale dithering controller of FIG. 2 according to an embodiment.

FIG. 2 is a diagram illustrating the low-grayscale dithering controller 300 included in the display device 1000 of FIG. 1. FIG. 3 is a diagram for explaining an operation of the low-grayscale dithering controller 300 of FIG. 2 according to an embodiment.

Referring to FIGS. 1, 2 and 3, the low-grayscale dithering controller 300 may include a dithering circuit 320 and a memory 340.

The dithering circuit 320 may analyze an input grayscale I_GRAY of the input image data IDATA to determine a low grayscale dithering area in the display area 100 to which the dithering is applied. For example, in the display area 100, an area that is applied with the input grayscale I_GRAY below the threshold grayscale may be determined as the low grayscale dithering area.

In addition, the dithering circuit 320 may select a dither grayscale DG corresponding to the input grayscale I_GRAY of the input image data IDATA from a lookup table LUT that is stored in the memory 340.

In an embodiment, the lookup table LUT may include a plurality of reference grayscales RG corresponding to each of input grayscales I_GRAY in the low grayscale range. For example, the low grayscale range of the lookup table LUT may include 1 to 10 input grayscales excluding the 0 grayscale (e.g., the black grayscale BG). In another embodiment, the low grayscale range of the lookup table LUT may include a different number of input grayscales (e.g., greater than 10 grayscales). For example, the lookup table LUT may include the input grayscale values of 11 to 15 grayscales.

In an embodiment, the dithering circuit 320 may implement a luminance corresponding to the input grayscale I_GRAY based on the dither grayscale DG and the black grayscale BG. For example, as shown in FIG. 3, the dithering circuit 320 may generate the first data DATA1 corresponding to a dither pattern included in a low grayscale dithering area LGDA of the display area 100. The dither pattern may include information on grayscales corresponding to each of the pixels included in the low grayscale dithering area LGDA (e.g., a position of a pixel PX to which the dither grayscale DG is applied and a position of a pixel PX to which the black grayscale BG is applied).

In an embodiment, the dither pattern may have a form in which the black grayscale BG and the dither grayscale DG are alternately displayed in time. For example, FIG. 3 shows a form in which grayscales corresponding to a predetermined low grayscale dithering area LGDA are expressed in a digital format. A pixel PX to which the dither grayscale DG is applied may be represented as "1", and a pixel PX to which the black grayscale BG is applied may be represented as "0". The dither grayscale DG may be determined as an 11 grayscale that is greater than the 10 grayscale corresponding to the threshold grayscale, and a data voltage of the 11 grayscale may be supplied to a corresponding pixel PX in response to a digital value 1.

FIG. 3 shows an area of a 2 by 2 dither pattern. In an odd-numbered frame, a data voltage corresponding to the dither grayscale DG may be supplied to a first pixel in a first row and a first column and a second pixel in a second row and a second column, and in an even numbered frame, a data voltage corresponding to the dither grayscale DG may be supplied to a third pixel in the first row and the second column and a fourth pixel in the second row and the first column. Such a dither pattern may have a predetermined shape and/or sequence according to the input grayscale I_GRAY.

In a case where a reference grayscale RG for expressing a grayscale in the low grayscale range is a single grayscale, a dithering noise that lowers expressiveness for a specific input grayscale I_GRAY may be generated. Such dithering noise may be visually recognized as mura in a displayed image.

The reference grayscales RG may be experimentally calculated by image analysis or the like through image capturing. For example, in the lookup table LUT shown in FIG. 2, the reference grayscale RG of a first grayscale A may be set in correspondence with the input grayscale I_GRAY of 1 grayscale, 2 grayscale, 3 grayscale, 4 grayscale, 6 grayscale, 7 grayscale, 9 grayscale, and 10 grayscale. The reference grayscale RG of a second grayscale B may be set in correspondence with the input grayscale I_GRAY of 5 grayscale. The reference grayscale RG of a third grayscale C may be set in correspondence with the input grayscale I_GRAY of 8 grayscale.

The first grayscale A, the second grayscale B, and the third grayscale C may be greater than the threshold grayscale (e.g., 10 grayscale) of the low grayscale range. Also, the sizes of the first grayscale A, the second grayscale B, and the third grayscale C may be irrelevant to a size relationship of the input grayscale I_GRAY. For example, a size of the second grayscale B and the third grayscale C may be larger than a size of the first grayscale A.

The dithering circuit 320 may select the reference grayscale RG corresponding to the input grayscale I_GRAY from the lookup table LUT as the dither grayscale DG. As described above, the dithering circuit 320 may perform temporal dithering in the low grayscale dithering area LGDA using a combination of the dither grayscale DG and the black grayscale BG. For example, the temporal dithering may be performed in a halftone method.

It is noted that the method in which the dithering circuit 320 performs dithering is not limited to the above example, and the dithering may be performed in various methods using the dither grayscale DG and the black grayscale BG.

Figure 4:
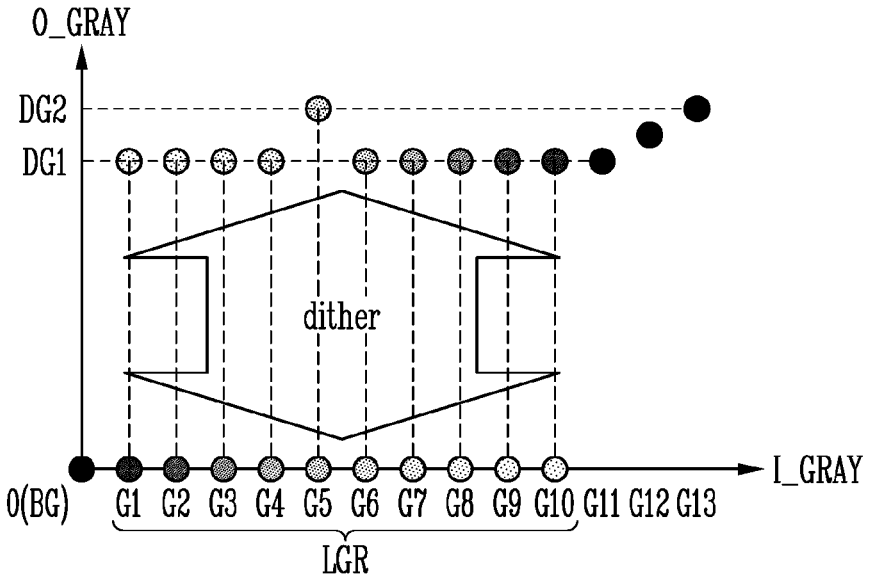
FIG. 4 is a diagram illustrating dither grayscales corresponding to input grayscales according to an embodiment.
Figures 5C, 6:
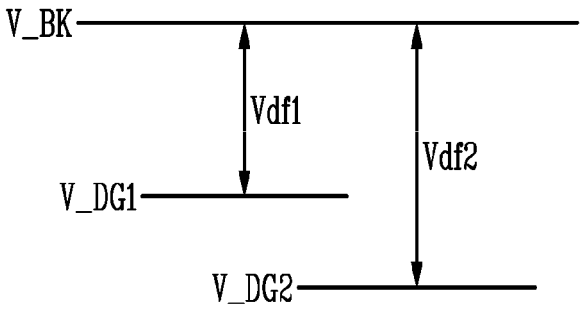

FIG. 4 is a diagram illustrating dither grayscales corresponding to input grayscales according to an embodiment. FIGS. 5A to 5C are diagrams illustrating examples of operations of the low-grayscale dithering controller 300 of FIG. 2.

Referring to FIGS. 1, 2, 4, 5A, 5B, and 5C, the low-grayscale dithering controller 300 may determine an output grayscale O_GRAY by applying dithering in response to the input grayscale I_GRAY in a low grayscale range LGR.

In an embodiment, the low grayscale range LGR to which the dithering is applied may include 10 grayscales including grayscale G1 to grayscale G10. Due to the physical characteristics, a pixel PX may not be able to distinguish the grayscale G1 to the grayscale G10 from one another by controlling a driving current of the driving transistor, the dithering may be used to express corresponding grayscales. In the present example, the grayscale G10 may be the threshold grayscale defining the low grayscale range LGR. In this case, the 0 grayscale may be the black grayscale BG, and the dithering may not be applied to the black grayscale BG.

The low-grayscale dithering controller 300 may express the input grayscale I_GRAY using a pattern combination of the dither grayscale DG and the black grayscale BG included in a predetermined mask pattern. The dither grayscale DG may be greater than the threshold grayscale. For example, the dither grayscale DG may have a grayscale value of the grayscale G11 or higher.

The low-grayscale dithering controller 300 may select the dither grayscale DG among the plurality of reference grayscales RG by looking up the lookup table LUT. For example, the reference grayscale RG may include a first dither grayscale DG1 and a second dither grayscale DG2. As shown in FIG. 4, the dither grayscale DG may be selected as one of the first dither grayscale DG1 corresponding to the grayscale G11 and the second dither grayscale DG2 corresponding to the grayscale G13. The data voltage corresponding to the first dither grayscale DG1 and the data voltage corresponding to the second dither grayscale DG2 may be different from each other.

It is noted that the grayscale values of the first and second dither grayscales DG1 and DG2 and the number of dither grayscales DG (i.e., the number of reference grayscales RG) are not limited to the above example.

For example, when the input grayscale I_GRAY is the grayscale G10, the first dither grayscale DG1 and the black grayscale BG may be selected as the output grayscale O_GRAY. The low-grayscale dithering controller 300 may output the dither pattern including a combination of the first dither grayscale DG1 and the black grayscale BG. Accordingly, the grayscale G10 may be expressed.

When the input grayscale I_GRAY is the grayscale G9, the low-grayscale dithering controller 300 may output the dither pattern including the combination of the first dither grayscale DG1 and the black grayscale BG. Similarly, when the input grayscale I_GRAY is one of the grayscale G1, the grayscale G2, the grayscale G3, the grayscale G4, the grayscale G6, the grayscale G7, and the grayscale G8, the low-grayscale dithering controller 300 may output the dither pattern including the combination of the first dither grayscale DG1 and the black grayscale BG.

As described above, various low grayscale outputs may be implemented by combining the first dither grayscale DG1 and the black grayscale BG. In a case where the first dither grayscale DG1 is applied to the dithering, a ratio to which the first dither grayscale DG1 is applied in the low grayscale dithering area LGDA of the display area 100 may increase as the input grayscale I_GRAY increases. This will be described in detail with reference to FIGS. 5A and 5C.

FIGS. 5A to 5C show the low grayscale dithering area LGDA of the display area 100 having a 4 by 4 pattern. The grayscales obtained by the dithering operation may be displayed in the low grayscale dithering area LGDA. Here, the low grayscale dithering area LGDA may refer to a portion of the display area 100 to which the dithering is applied.

It is noted that the following description is based on a presumption that a first input grayscale I_GRAY1 is greater than a second input grayscale I_GRAY2, and the second input grayscale I_GRAY2 is greater than a third input grayscale I_GRAY3. As a non-limiting example, the first input grayscale I_GRAY1 may be the grayscale G6, the second input grayscale I_GRAY2 may be the grayscale G5, and the third input grayscale I_GRAY3 may be the grayscale G4.

In an embodiment, the first and second dither grayscales DG1 and DG2 may be applied to a random position within the low grayscale dithering area LGDA or a predetermined dither pattern for a frame. At this time, even if the position to which the first and second dither grayscales DG1 and DG2 are applied may be changed, a ratio of the dither grayscale DG (e.g., the first dither grayscale DG1 or the second dither grayscale DG2) in the low grayscale dithering area LGDA may be maintained constantly at a value corresponding to the input grayscale I_GRAY.

As shown in FIG. 5A, in response to the first input grayscale I_GRAY1, the first dither grayscale DG1 may be applied to the low grayscale dithering area LGDA at a ratio of 9/16. In addition, as shown in FIG. 5C, in response to the third input grayscale I_GRAY3, the first dither grayscale DG1 may be applied to the low grayscale dithering area LGDA at a ratio of 6/16 (or 3/8).

As described above, when the low-grayscale dithering controller 300 performs the dithering operation based on the first dither grayscale DG1, the ratio to which the first dither grayscale DG1 is applied in the low grayscale dithering area LGDA of the display area 100 may increase as the input grayscale I_GRAY increases.

When the low-grayscale dithering controller 300 performs the dithering based on the first dither grayscale DG1 in response to the second input grayscale I_GRAY2, mura may be visually recognized in a displayed image due to a dithering noise. Accordingly, for the second input grayscale I_GRAY2, the low-grayscale dithering controller 300 may perform the dithering using the second dither grayscale DG2 that is different from the first dither grayscale DG1.

Accordingly, an image may be displayed in the low grayscale dithering area LGDA with a grayscale (and luminance corresponding thereto) similar to the second input grayscale I_GRAY2. For example, as shown in FIG. 4, an image displayed based on the second dither grayscale DG2 may have a grayscale corresponding to the grayscale G5.

For example, as shown in FIG. 5B, in response to the second input grayscale I_GRAY2, the low-grayscale dithering controller 300 may apply the second dither grayscale DG2 to the low grayscale dithering area LGDA at the ratio of 6/16 (or 3/8). In this case, the second dither grayscale DG2 may be greater than the first dither grayscale DG1. In an embodiment, as shown in FIGS. 5B and 5C, the ratio of the second dither grayscale DG2 in the low grayscale dithering area LGDA corresponding to the second input grayscale I_GRAY2 may be the same as the ratio of the first dither grayscale DG1 in the low grayscale dithering area LGDA corresponding to the third input grayscale I_GRAY3.

It is noted that the ratio of the second dither grayscale DG2 in the low grayscale dithering area LGDA corresponding to the second input grayscale I_GRAY2 may be smaller than the ratio of the first dither grayscale DG1 in the low grayscale dithering area LGDA corresponding to the third input grayscale I_GRAY3.

In a case where the input grayscale I_GRAY is smaller than the third input grayscale I_GRAY3, the ratio of the first dither grayscale DG1 applied to the dither pattern may be smaller than the ratio of the second dither grayscale DG2 shown in FIG. 5B.

In other words, the ratio of the second dither grayscale DG2 in the low grayscale dithering area LGDA for implementing the second input grayscale I_GRAY2 may be determined regardless of ratios of the first dither grayscale DG1 for implementing other input grayscales I_GRAY.

As described above, the display device 1000 may perform the dithering on a low grayscale image based on the dither grayscale DG that is selected from a plurality of reference grayscales RG according to the input grayscale I_GRAY within the low grayscale range LGR. Accordingly, unevenness in color coordinates in a low grayscale range (e.g., 10 grayscales or less out of 256 grayscales) and/or mura due to a dithering noise in the low grayscale image may be minimized or eliminated, therefore an image quality of the display device 1000 may be improved.

FIG. 6 is a diagram illustrating an example of a relationship between dither grayscales and data voltages.

Referring to FIGS. 1, 2, 4, 5A, 5B, 5C, and 6, a magnitude of a data voltage may be determined according to the dither grayscale DG.

The data driver 240 included in the display driver 200 may convert the second data DATA2 into a data voltage in an analog format and supply the data voltage to the data lines DL1 to DLm.

In an embodiment, the data driver 240 may include a digital-to-analog (DA) converter that converts a grayscale value in a digital format into the data voltage. The data driver 240 may convert the dither grayscale DG into a dither data voltage and convert the black grayscale BG into a black data voltage V_BK.

The data driver 240 may convert the first dither grayscale DG1 to a first dither data voltage V_DG1, and may convert the second dither grayscale DG2 to a second dither data voltage V_DG2.

To express the first input grayscale I_GRAY1, the data driver 240 may apply the first dither data voltage V_DG1 and the black data voltage V_BK to the low grayscale dithering area LGDA.

to express the second input grayscale I_GRAY2, the data driver 240 may apply the second dither data voltage V_DG2 and the black data voltage V_BK to the low grayscale dithering area LGDA.

Since the second dither grayscale DG2 is greater than the first dither grayscale DG1, a second voltage deviation Vdf2 that is a voltage deviation between the second dither data voltage V_DG2 and the black data voltage V_BK may be greater than a first voltage deviation Vdf1 that is a voltage deviation between the first dither data voltage V_DG1 and the black data voltage V_BK.

That is, when an image having a low grayscale in the low grayscale range (e.g., 10 grayscale or less) is expressed in the display area 100, a magnitude of the dither data voltage may be changed according to the input grayscale I_GRAY.

As an example, FIG. 6 shows a data voltage relationship of a P-type driving transistor (P-channel transistor) of the pixel PX. In this case, the first and second dither data voltages V_DG1 and V_DG2 may be smaller than the black data voltage V_BK.

In a case where the driving transistor of the pixel PX is an N-type (N-channel transistor), the first and second dither data voltages V_DG1 and V_DG2 may be greater than the black data voltage V_BK. Also, the second dither data voltage V_DG2 may be greater than the first dither data voltage V_DG1. However, a magnitude relationship between the first voltage deviation Vdf1 and the second voltage deviation Vdf2 may be irrelevant to the type of the driving transistor, and the second voltage deviation Vdf2 may be greater than the first voltage deviation Vdf1.

As described above, a magnitude of the dither data voltage supplied to the display area 100 may be changed according to the input grayscale I_GRAY within the low grayscale range LGR. Accordingly, unevenness in color coordinates in a low grayscale range (e.g., 10 grayscales or less out of 256 grayscales) and/or mura due to a dithering noise in the low grayscale image may be minimized or eliminated.

Figures 7, 8:
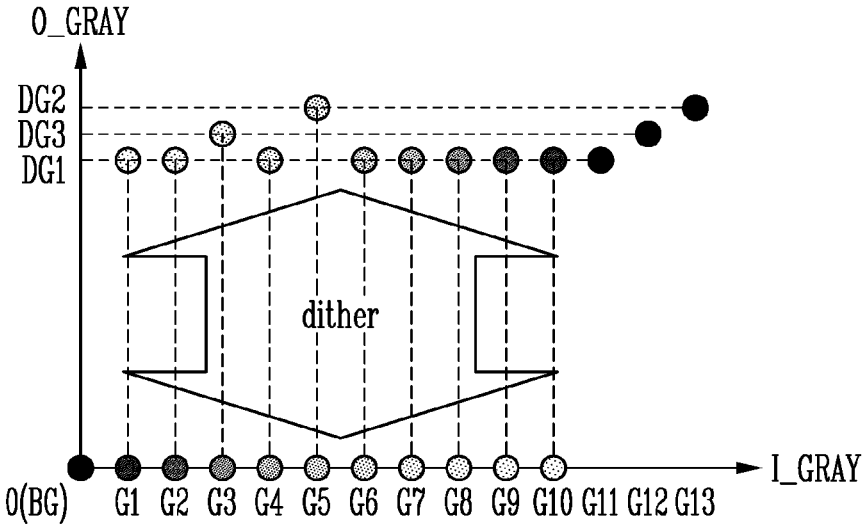
FIG. 7 is a diagram illustrating dither grayscales corresponding to the input grayscales according to another embodiment.
FIG. 8 is a diagram illustrating an example of an operation of the low-grayscale dithering controller of FIG. 2.

FIG. 7 is a diagram illustrating dither grayscales corresponding to the input grayscales according to another embodiment. FIG. 8 is a diagram illustrating an example of an operation of the low-grayscale dithering controller 300 of FIG. 2.

The operation of the low-grayscale dithering controller 300 according to the present embodiment is substantially the same as the operation of the low-grayscale dithering controller 300 described with reference to FIGS. 4 to 6 except that a third dither grayscale DG3 is added. The same reference numerals are used for the same or corresponding components, and duplicate descriptions will be omitted.

Referring to FIGS. 1, 2, 4, 5A, 5B, 5C, and 7, the low-grayscale dithering controller 300 may determine the output grayscale O_GRAY by applying dithering in response to the input grayscale I_GRAY in the low grayscale range LGR.

In an embodiment, the low-grayscale dithering controller 300 may select the third dither grayscale DG3 to express the input grayscale I_GRAY of the grayscale G3. For example, the third dither grayscale DG3 may correspond to the grayscale G12. The grayscale G3 can be most accurately expressed by the dithering of the grayscale G12 and the black grayscale BG.

Referring to FIG. 8, in response to a fourth input grayscale I_GRAY4, the low-grayscale dithering controller 300 may apply the third dither grayscale DG3 to the low grayscale dithering area LGDA at a ratio of 4/16 (that is, 1/4). The fourth input grayscale I_GRAY4 may correspond to the grayscale G3.

The ratio to which the third dither grayscale DG3 is applied to the low grayscale dithering area LGDA to display the grayscale G3 may be set irrespective of the ratio to which the first dither grayscale DG1 is applied to the same area to display the grayscale G4 and the ratio to which the first dither grayscale DG1 is applied to the same area to display the grayscale G2.

As described above, the quality of a low grayscale image displayed by the display device 1000 may be further improved by subdividing the dither grayscale DG within the low grayscale range LGR according to the input grayscale I_GRAY.

Figure 9:
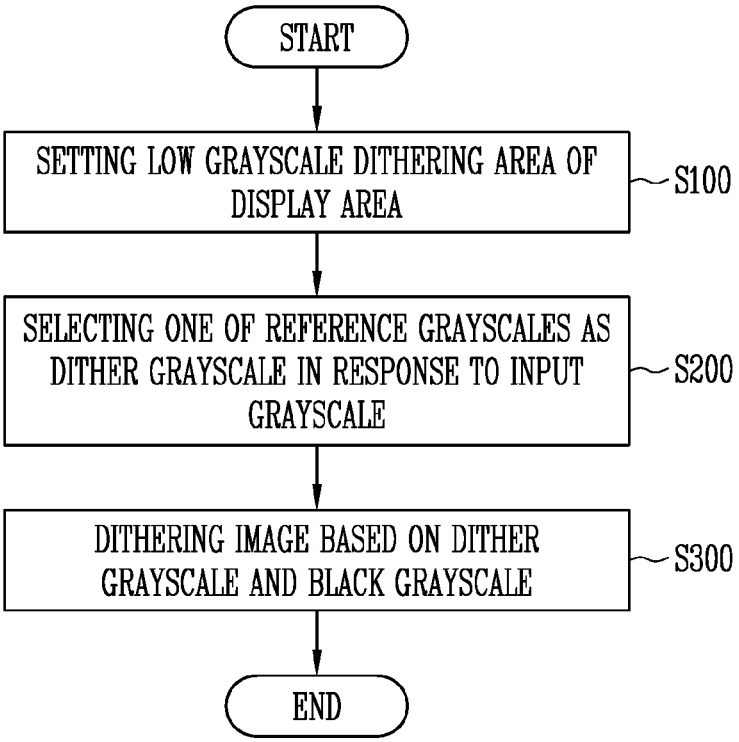
FIG. 9 is a flowchart illustrating a method of driving a display device according to an embodiment.

FIG. 9 is a flowchart illustrating a method of driving a display device according to an embodiment.

Referring to FIG. 9, the method of driving the display device (e.g., the display device 1000 of FIG. 1) may include setting a low grayscale dithering area of a display area (S100), selecting one of reference grayscales as a dither grayscale in response to an input grayscale (S200), and dithering an image based on the dither grayscale and a black grayscale (S300).

The low grayscale dithering area may be set in the display area (S100). For example, input grayscales of input image data supplied to the display device from an external device (e.g., a graphic processor) may be analyzed to determine a position or area that has a grayscale in a low grayscale range below a threshold grayscale. The position or area in the display area having low input grayscales may be set as the low grayscale dithering area (S100).

The display device may include a lookup table in which a plurality of reference grayscales corresponding to each of the low input grayscales is stored. Accordingly, a reference grayscale corresponding to the input grayscale may be selected as the dither grayscale (S200).

Image dithering in the low grayscale dithering area may be performed based on the selected dither grayscale and the black grayscale (S300). In the image dithering, an image pattern combining the dither grayscale and the black grayscale may be output to display an image of the input grayscale. According to one embodiment, the method for the dithering operation described with reference to FIGS. 2 to 8 may be used to apply the image dithering.

The method of driving the display device that performs a dithering operation by selecting the dither grayscale from the plurality of reference grayscales has been described in detail with reference to FIGS. 2 to 8. Therefore, duplicate descriptions are omitted.

As described above, the display device and the method of driving the same according to various embodiments of the present disclosure may perform dithering of a low grayscale image using a dither grayscale selected from a plurality of reference grayscales according to an input grayscale within a low grayscale range. Accordingly, unevenness in color coordinates in a low grayscale range and/or mura due to a dithering noise in the low grayscale image may be minimized or eliminated, and an image quality of the display device may be improved.

However, the present disclosure is not limited to the above-described embodiments, and the display device and the method of driving the display device may be variously extended without departing from the spirit and scope of the present disclosure.

As described above, some embodiments of the present disclosure have been described with reference to the drawings. However, those skilled in the art will appreciate that various modifications and changes can be made to the present disclosure without departing from the spirit and scope of the present disclosure as set forth in the appended claims.

What is claimed is:

1. A display device comprising:

a display area including a plurality of pixels;

a low-grayscale dithering controller selecting a dither grayscale according to an input grayscale of input image data that is in a low grayscale range below a threshold grayscale, and generating dithered input image data by performing a dithering operation on the input image data in the low grayscale range based on the dither grayscale; and a display driver driving the plurality of pixels based on the dithered input image data, wherein the low-grayscale dithering controller comprises a memory storing a lookup table that includes a plurality of reference grayscales corresponding to each of grayscales in the low grayscale range, wherein the low-grayscale dithering controller selects one of the plurality of reference grayscales as the dither grayscale in response to the input grayscale, wherein the plurality of reference grayscales is greater than the threshold grayscale, wherein the low-grayscale dithering controller performs the dithering operation by expressing the input grayscale based on the dither grayscale and a black grayscale, and wherein for the dither grayscale being same, a ratio to which the dither grayscale is applied in a low grayscale dithering area in the display area in which the dithering operation is performed increases as the input grayscale increases.

2. The display device of claim 1, wherein the low-grayscale dithering controller selects a first dither grayscale in response to a first input grayscale, and selects a second dither grayscale in response to a second input grayscale that is smaller than the first input grayscale, and wherein the second dither grayscale is greater than the first dither grayscale.

3. The display device of claim 2, wherein the low-grayscale dithering controller selects the first dither grayscale in response to a third input grayscale that is smaller than the second input grayscale.

4. The display device of claim 3, wherein, in the low grayscale dithering area of the display area, a second ratio to which the second dither grayscale is applied is different from at least one of a first ratio to which the first dither grayscale is applied in response to the first input grayscale and a third ratio to which the first dither grayscale is applied in response to the third input grayscale.

5. The display device of claim 4, wherein, in the low grayscale dithering area, the second ratio to which the second dither grayscale is applied is less than or equal to the third ratio to which the first dither grayscale is applied in response to the third input grayscale.

6. The display device of claim 3, wherein the display driver comprises a data driver supplying a data voltage of the dither grayscale and a black data voltage of the black grayscale to the plurality of pixels.

7. The display device of claim 6, wherein a second voltage deviation between a second data voltage of the second dither grayscale and the black data voltage is greater than a first voltage deviation between a first data voltage of the first dither grayscale and the black data voltage.

8. The display device of claim 1, wherein the low grayscale range includes grayscales that are greater than the black grayscale and lower than the threshold grayscale.

9. The display device of claim 8, wherein the black grayscale is a lowest grayscale, the threshold grayscale is a tenth grayscale of an eight-bit grayscale, and the plurality of reference grayscales corresponds to eleventh to fifteenth grayscales of the eight-bit grayscale.

10. A method of driving a display device comprising:

setting a low grayscale dithering area in a display area based on an input grayscale of input image data in a low grayscale range below a threshold grayscale;

selecting one of a plurality of reference grayscales as a dither grayscale in response to the input grayscale, wherein the plurality of reference grayscales corresponds to each of grayscales in the low grayscale range; and performing image dithering in the low grayscale dithering area based on the dither grayscale and a black grayscale, for the dither grayscale being same, the method further comprises increasing a ratio to which the dither grayscale is applied in the low grayscale dithering area as the input grayscale increases.

11. A method of driving a display device comprising:

setting a low grayscale dithering area in a display area based on an input grayscale of input image data in a low grayscale range below a threshold grayscale;

selecting one of a plurality of reference grayscales as a dither grayscale in response to the input grayscale, wherein the plurality of reference grayscales corresponds to each of grayscales in the low grayscale range;

performing image dithering in the low grayscale dithering area based on the dither grayscale and a black grayscale;

selecting a first dither grayscale in response to a first input grayscale; and selecting a second dither grayscale in response to a second input grayscale that is smaller than the first input grayscale, wherein the second dither grayscale is greater than the first dither grayscale.

12. The method of claim 11, further comprising selecting the first dither grayscale in response to a third input grayscale that is smaller than the second input grayscale.

13. The method of claim 12, wherein, in the low grayscale dithering area, a second ratio to which the second dither grayscale is applied is equal to or less than a first ratio to which the first dither grayscale is applied in response to the third input grayscale.

14. The method of claim 13, wherein a second voltage deviation between a second data voltage of the second dither grayscale and a black data voltage of the black grayscale is greater than a first voltage deviation between a first data voltage of the first dither grayscale and the black data voltage.

15. The method of claim 11, wherein the low grayscale range includes grayscales equal to or greater than the black grayscale and lower than the threshold grayscale.

* * * * *